United States Patent [19]

Childers et al.

[11] 3,954,404

[45] May 4, 1976

[54] DIPHENYL CONTINUOUS FOAM DYEING WITH FABRIC RUNNING OVER ROLLS IN FOAM BATH

[75] Inventors: Billy M. Childers, Chattanooga, Tenn.; Charles D. Fesperman, Jr., Dalton, Ga.

[73] Assignee: RCA Corporation, New York, N.Y.

[22] Filed: June 3, 1974

[21] Appl. No.: 476,057

Related U.S. Application Data

[63] Continuation of Ser. No. 265,228, June 22, 1972, abandoned, which is a continuation of Ser. No. 19,627, March 16, 1970, abandoned.

[52] U.S. Cl. ..... 8/175; 8/1 XB; 8/149.1; 8/158; 8/151; 8/168 A; 8/21 A; 8/21 B; 8/21 C; 8/21 D

[51] Int. Cl.[2] ..... D06P 5/00

[58] Field of Search ..... 8/21 A, 21 B, 21 C, 8/1 R, 79, 19, 149.1, 175, 1 XB

[56] References Cited

UNITED STATES PATENTS

| | | | |
|---|---|---|---|
| 1,815,279 | 7/1931 | Takamine | 8/151 |
| 1,948,568 | 2/1934 | Faber et al. | 8/19 |
| 2,023,013 | 12/1935 | Faber et al. | 8/149.1 |
| 2,971,458 | 2/1961 | Kumins | 8/62 |
| 3,389,549 | 6/1968 | David | 57/140 BY |
| 3,468,121 | 9/1969 | Nokashima | 57/140 BY |
| 3,475,111 | 10/1969 | Meyer | 57/140 BY |
| 3,562,844 | 2/1971 | Thompson | 15/314 X |
| 3,762,860 | 10/1973 | Abrahams | 8/21 A |

FOREIGN PATENTS OR APPLICATIONS

| | | |
|---|---|---|
| 1,134,221 | 8/1968 | United Kingdom |

OTHER PUBLICATIONS

Matthews, Application of Dyestuff to Textiles Paper Leather & Other Material, pp. 398–404, Pub. 1920 by John Wiley, N.Y.C.

*Primary Examiner*—Donald Levy
*Attorney, Agent, or Firm*—Edward J. Norton; Joseph D. Lazar; Robert M. Rodrick

[57] ABSTRACT

The present invention relates to a textile method of continuously dyeing a fibrous material and particularly a pile fabric which includes the steps of applying a foam containing a dye to the fiber or fabric, subjecting the foam treated material to a steaming operation to effect fixation of the dye, and washing the dyed material. The apparatus includes means for producing a foam, containing a dye, a tank for containing the foam and immersing the material to be dyed therein, a steamer that is in direct communication with the foam tank, and a wash box that receives the steamed material directly into its water bath without subjecting the dyed material to the atmosphere.

5 Claims, 4 Drawing Figures

DIPHENYL CONTINUOUS FOAM DYEING WITH FABRIC RUNNING OVER ROLLS IN FOAM BATH

This is a continuation of application Ser. No. 265,228, filed June 22, 1972, now abandoned, which, in turn, is a continuation of application Ser. No. 19,627, filed Mar. 16, 1970, now abandoned.

BACKGROUND OF THE INVENTION

1. Field of the Invention

The present invention relates to continuous dyeing techniques for fibers and in particular to the carpet industry.

2. Description of the Prior Art

In the last several years, the carpet industry has seen a particularly rapid expansion, which is expected to continue in the foreseeable future. Between 1960 and 1970, U.S. carpet fiber production will have grown almost threefold compared with a slower, but nevertheless increasing, rate of growth in Europe. There are many reasons for this expansion. Increasing standards of living, the increasing introduction of relatively cheap, hard wearing, synthetic fibers and a marked tendency to employ carpeting to replace hard floor coverings in homes, schools, hospitals and offices, have all played their part. Tufted carpets have now almost completely replaced conventional woven types in the U.S.A. and a continuing trend in this direction is evident in Europe also, although at present only 50 percent of production is of tufted types.

World production of carpets now stands at some 560 million square yard p.a., of which the U.S.A. and European manufacturers produce about 55 and 35 percent respectively. The greatest rate of expansion in all countries lies in tufted carpets, for which nylon and acrylic fibers will be of prime importance. In Europe, and more particularly the U.K., however, viscose rayon is still widely used, in contrast to the U.S.A. In the U.S.A., however despite the advent of polyester and polypropylene, the share between the various fiber types seem unlikely to show any major change.

B. C. F. Nylon is the major fiber used in tufted carpets both in the U.S.A. and Europe and the bulk of these carpets are piece dyed on the winch. It is somewhat surprising that continuous dyeing techniques were not widely adopted in the U.S.A. until quite recently, and that the initial lead in this field has been mainly in the U.K. and Western Germany. Increasing usage is now being made of continuous dyeing techniques, however, which are not confined to piece dyeing only, but may also be employed for yarn and loose stock dyeing. Continuous dyeing of piece goods offers the greatest economy and flexibility in production, allows minimum stockholding of dyed fiber and affords the carpet produced to deliver the finished goods in the shortest possible time following the receipt of an order. These factors are particularly important as there is an increasing tendency to minimize capital tied up in stock, by the producer wholesaler and retailer alike, and for the customer (with the exception of contract work) to order simply from pattern books of specific shade ranges.

The continuous dyeing of tufted carpets is, in many ways, much more difficult, mechanically, than the continuous dyeing of fabrics. The stages involved are, however, the same, namely, the even impregnation of dye on the goods, than colour fixation, and finally washing and/or after treatment and drying. With tufted carpets the machinery must be constructed much more robustly since the goods, particularly in the wet state, have a considerably higher unit weight. Tufted carpets up to 15 ft. in width are now commonly produced, so that the pad-mangles, steamers etc., that are available for the processing of woven goods are generally inadequate for carpets. This led individual firms, who adopted continuous dyeing methods for carpets, to designing their own equipment. Recently, however, a number of complete processing units have become commercially available. These differ mainly in the techniques employed at the due impregnation stage.

Continuous dyeing systems lose much of their appeal if the goods to be dyed cannot be prepared continuously. They are even more attractive if no preparation at all is necessary. European practice is, in fact, to dye all carpets without any pre-scouring.

As previously indicated the stages involved in dyeing carpets continuously are:

1. Dye impregnation
2. Dye fixation
3. Washing off
4. Drying

Dye impregnation is the part of the process that has received the greatest attention by machinery manufacturers since the uniform application of dye liquor across a 15 ft wide carpet without pile deformation presented new problems, and several solutions have been evolved.

Perhaps the least sophisticated, but nevertheless wellproven and versatile, method involves the pad/-drain technique. Dye liquor is applied by padding the carpet without any squeezing action. After passing through the dye liquor the carpet travels in an inclined or vertical plane so that the downward flow of the liquor attains an equilibrium with the upward movement of the carpet. The pick-up attained is controlled by the distance, angle, and speed of carpet travel and by the type of carpet being processed.

Following more conventional techniques, it is possible to utilize special pad-mangles (operating on the "swimming" or "floating" roller principle) which give an even expression over the full width of the carpet. A continuous dyeing range operating in this way is that developed by *Beloit-Kleinewefers*. However, machines involving a squeezing action of this type tend to have limitations when used on certain carpet constructions (e.g. deeply sculptured designs, or with acrylic carpets when the crushed pile will tend to become set by steaming and subsequent rapid cooling in the washing-off section).

All the above methods, since these involve total immersion of the carpet in the dye liquor result, to varying degrees, in dyeing of the jute backing of the carpet, in addition to the carpet pile. On the other hand, the total immersion technique can handle any type of pile fabric range from short plush pile to shag pile construction and even needlefelts. With the machines developed by Gerber and by Justers the dye liquor is applied to the face of the carpet so that the liquor uptake by the jute backing can be controlled to some extent. The Gerber/-Deep Dye "Unicolor" system of application consists of a driven drum covered laterally, with rubber ribbing. The slotted spaces between the ribs are filled from an adjustable dosing device, which allows the amount of liquor applied to be controlled depending on the type of carpet processed. Liquor pick-up varies between 100 and 250 percent. The carpet passes, pile down, through the nip between the driven drum and an upper roller. The pressure between the rollers requires adjustment according to the viscosity of the dye liquor and type of carpet to be dyed so as to ensure good colour penetration into the pile. It must not be too high, on the other hand, otherwise bar marks may be evident in the dyed carpet. This defect can occur more particularly on needle felts and for dyeing this type of floor covering the Gerber "Unipad" system is more suitable. This makes use of a tilting trough of very small volume in which runs of a soft rubber-coated roller. By tilting the trough the depth of immersion of the roller, and hence the amount of liquor picked up, can be controlled to suit the carpet being processed.

In contrast to all the foregoing techniques the Kuster system involves a two-stage application. The carpet is first impregnated with the necessary auxiliaries and chemicals (but no dye) by a conventional padding procedure using a swimming roller mangle. The liquor pick-up at this stage is about 100 percent. The carpet then passes to the dye applicator. This consists of a stainless steel roller rotating in a constant head of dye liquor in a trough. The speed of rotation and the viscosity of the liquor determine the liquor pick-up of the roller. A fibre glass doctor blade, running the full width of the roller then removes the dye liquor and allows it to flow down onto to the surface of the carpet passing, pile upwards, beneath. The additional liquor pick-up at this stage is about 300 percent, giving a total pick-up of 400 percent.

For dye fixation, steaming, without intermediate drying, is invariably used for reasons of economy and versatility. Saturated steam at 102°–105°C (215°–220°F) generally gives the best results with nylon and acrylic carpets since there is no tendency to drying-out, which might lead to dye migration to the tips of the pile nor does it give rise to water-spotting so long as the roof of the steamer is correctly designed. However, in order to ensure rapid heating of the carpet, which may contain as much as four times its weight of water on entering the steamer, the steamers may be equipped with pre-heating zones (e.g. infra-red heaters, or steam jet entry passages fed with superheated steam.) In steamers, not fitted with such pre-heating zones it may be preferable to give some degree of superheat to the steamer as a whole (e.g. by internal steam chests fed with pressure steam), giving a temperature (dry bulb thermometer) of 120°–130°C (250°–265°F). For polyester carpets the use of a superheated steam atmosphere of this type is necessary in order to obtain sufficiently rapid dye diffusion with the relatively short steaming times employed.

The type of steamer recommended varies, but in all cases the main requirement is that the pile of carpet does not come into contact with rollers which might cause distortion of the pile and marking-off. Festoon steamers are most favoured (Kusters, Kleinewefers, B.D.A. machines) but spiral (Gerber) and horizontal steamers (Stalwart machine) are also used. The rollers in the steamers should be driven and, particularly in festoon steamers, the drives should be independent and controllable to maintain constant loop lengths.

A further unit available, but not so far described owing to the absence of published information on the precise impregnation method is that produced by Fleissner. This utilizes their well known drum principle. The steaming chamber consists of a perforated drum steamer combined with a festoon steamer, or of a series of three perforated drum steamers. The advantage of drum steamers is that the steam is circulated right through the carpet and they do not rely so much on heat transfer from the upper and lower surfaces of the carpet - an advantage with deep pile constructions.

Any subsequent wet treatments are carried out on open width continuous washing ranges, with a variety of refinements to produce interchange between the liquor in the tanks and that in the carpet. Cold water is usually employed because of the relatively large volumes required, and conservation of water may be achieved by counter-current flow or recirculation systems. Thus the Justers unit employs tangentially running ribbed rubber belts to achieve a fast water current past the carpet in the washing tanks, between which are fitted squeeze rollers. The Stalward and Beloit-Kleinewefers machines use counter-current wash tanks with spray pipes and light squeezing between the tanks. The Fleissner unit, on the other hand, employs the drum washer principle.

One good type of washing off system in the Gerber "Rotomat" This is designed to obtain highly efficient washing off in the minimum space and uses an alternating wash/squeeze sequence with fresh wash liquor being supplied after each squeeze.

Because of the large quantity of water retained by carpets after wet treatments, drying is relatively expensive and as much water as possible must be removed mechanically prior to drying. Mangling, whilst being the most efficient can distort the pile, although the provision of rotary beaters prior to the drier will minimize this effect. An alternative method which does not cause pile distortion is to pass the carpet over an efficient vacuum suction slot. A wide variety of drying machines suitable for carpets are now available, mainly of the stenter type (sometimes with steam heated drum pre-driers).

In summary, the techniques that have been employed in prior art continuous dyeing techniques have always utilized the dyeing medium in the liquid state.

In the dip-pad type process both the dye and the chemicals for treating the fabric are applied at one station or position. However, it should be noted that the dye and the chemicals are applied in the liquid state.

In the Kuster process the chemicals for treating the fabric are applied at a first station by squeezing and the dye is applied at a second station. Here again, both the chemicals and the dye that are applied are in a liquid state.

Furthermore, all of the prior art processes depended on a foaming action occurring within the steamer.

In those prior art processes that employ compression in the application of dye, dealing with a fabric piece in excess of 12 feet resulted in variations in the finish of the resulting product.

The dyeing process of the present invention affords the first system in which the dye chemical mixture is applied in foam form in one application. The present invention can attain higher ratios of weight of dye pick-up to the weight of fabric to be dyed affording a range from 2 to 5 ratio. Whereas, prior art methods or processes afforded approximately 3 lbs. of paste pick-up to 1 lb. of fabric to be dyed.

The method of the present invention therefore, can incorporate more dye if desired and do so with less waste, since there is no waste of chemicals or dye in the steamer. Also, by virtue of the fact that the dye is applied to the fabric or material to be dyed in foam form the dye is in a more dispersed state affording for a faster heat up and fixation of the dye within the steamer thereby reducing the danger of migration of dye to the tips of the pile and avoids the problem of any over foaming inside of the steamer. Also, the steamer and wash-box arrangement of the present invention affords for a more gradual cool-down thereby conserving the steam requirement.

The present invention offers simplicity of application of chemicals and dyes while affording better pick up control when processing shag and plush type fabrics. The control of pick up produces even distribution over the fabric insuring full penetration into the fabric.

Since in the present process the dye is applied in foam form all tufts are saturated with highly dispersed foam, thereby, reducing the heat up time upon entering the steamer as compared to the prior art. This affords for faster fixation rates.

Furthermore, since the foam is already generated before entering the steamer, this system encounters no problem in handling synthetic primary backing where sylicones may inhibit foam formation after entering the steamer. The present process is also adaptable to shorter runs that utilize in the neighborhood, some 7 to 10 rolls. In addition, the turn-around-time (set up for a different run) is reduced because of the simplicity of the apparatus and method employed.

SUMMARY OF THE INVENTION

The present invention relates to a method and apparatus for continuously dyeing a textile fibrous material. The method includes the steps of applying a foam containing a dye to the fibrous material, subjecting the foam treated material to a steaming operation to effect fixation of the dye, and then washing the dyed material.

The apparatus includes means of producing a foam containing a dye, means for applying the foam; a steamer for effecting fixation of the dye; and a wash box that receives the steamed textile fibrous material directly into its water bath without subjecting the dyed material to the atmosphere.

DESCRIPTION OF THE ILLUSTRATIVE EMBODIMENT

Figures 1, 2, 3, 4:
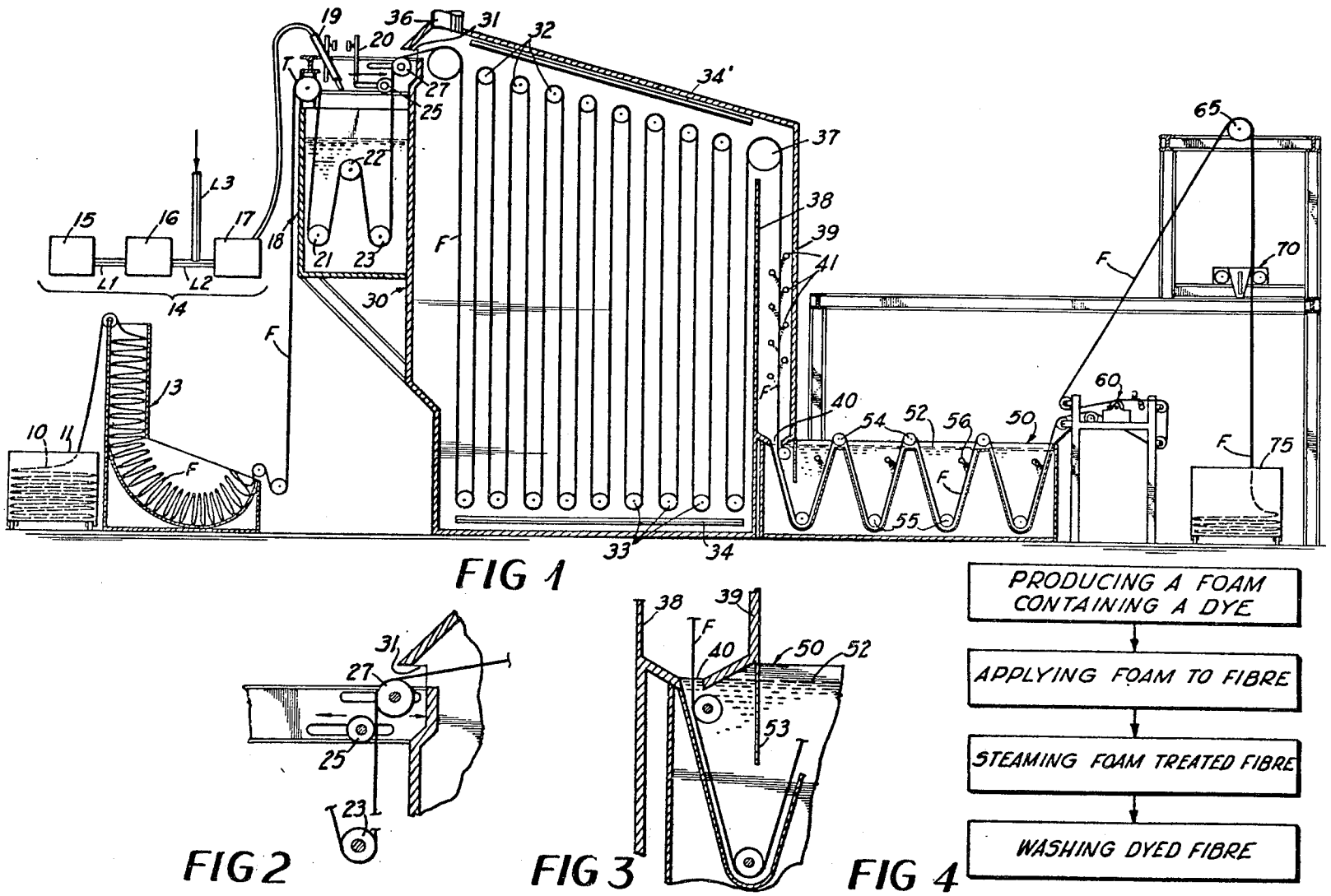
FIG. 1 is a schematic view of the apparatus of the present invention.
FIG. 2 is a fragmentary cross section showing an adjustable doffer arrangement for removing excess foam prior to entering the steamer.
FIG. 3 is a fragmentary cross section showing the dyed material leaving the steamer and intering the wash box without being exposed to the atmosphere; and, FIG. 4 is a flow chart showing the sequential steps of the method of the present invention for continuously dyeing fibrous material.

The method and apparatus of the present invention is particularly adaptable to the continuous dyeing of pile fabrics such as carpets of the styles including plush, shags, high-low and loop piles. The dyeing process can be utilized for solid colors, two-tone and three-tone application. This process lends itself particularly to the dyeing of synthetic fibers such as polymides, polyesters, polypropylenes and acrylics.

Referring to FIG. 1, the supply of fabric to be dyed is generally indicated by the numeral 10 which is conveyed to the dyeing location by dollies 11. A fabric accumulator and feed means is generally indicated by numeral 13.

The foam machine 14 includes a holding tank 15 for containing a dye chemical mixture. The tank 15 is connected by a pipe line $L_1$ to a positive displacement pump 16. The positive displacement pump 16 is connected by pipe line $L_2$ to a homogenizer 17. The homogenizer 17 may be the type disclosed in U.S. Pat. No. Re. 23,772, that is manufactured and sold in the U.S. by the Firestone Company as their pump models No. 116 or 117.

Between the positive displacement pump 16, and the homogenizer 17 air is introduced into the line $L_2$ from line $L_3$ under pressure at approximately 40 lbs. per sq. inch.

The R.P.M. of the pump 16 and homogenizer 17 and the air pressures are variable and may be adjusted to obtain varying foam densities at varying volume or delivery rates.

Representative settings for the foam machine would be as follows: Pump to operate at 900 RPM; Homogenizer to operate at 200 RPM; and, air introduced at a pressure of 40 lbs. per sq. inch.

The foam containing a dye is fed into a foam dye box 18, by foam dispenser 19 which is mounted above the dye box 18 and reciprocates its breadth by means of a transverse drive mechanism 20. Since the dye box 18 is uncovered (as seen in the sectional view in FIG. 1) and thereby vented to the atmosphere, and the foam dispenser 19 is thus also exposed to the atmosphere at the point of discharge, the foam is dispensed into dye box 18 at atmospheric pressure.

The foam that is fed into foam dye box 18 is maintained within a density range of 0.2 to 0.4 of a specific gravity range of 0.2 to 0.3. Also, the pH of the foam is maintained within the range of 3 to 9. Variation in density of the foam is achieved by varying the RPM of the pump 16 and the pressure of the air in line $L_3$. The pH of the foam is adjusted by chemical variation.

The fabric F enters the foam dye box 18 with the tufted or pile side T (woven surface) disposed upwardly and moves downwardly under feed roller 21 thence upwardly over idler roller 22, thence downwardly under drive roller 23, and thence upwardly out of the foam dye box 18 into the steamer 30.

The level of the foam is maintained so that rollers 21, 22 and 23 in the foam dye box 18 are covered. It will be appreciated, thus, that as the foam is dispensed by the reciprocating action effected by mechanism 20, the foam will be distributed substantially evenly over the rollers 21, 22, and 23. By maintaining the level of foam substantially even and covering the rollers, a uniform quantity of foam will be applied to the fabric across its entire breadth as it passes within foam dye box 18. As the fabric F moves from the foam dye box 18 out of the foam bath an appropriate doffer 25 (FIG. 2) may be utilized to remove any desired amount of foam prior to entry into the steamer 30.

The contact pressure of the doffer 25, FIG. 2, may be adjusted by selected transverse placement of roller 27.

The steamer 30 is positioned adjacent the foam dye box 18 and has an entry throat 31 through which the foam treated fabric F enters. The steamer 30 is provided with a plurality of upper rollers 32 and lower rollers 33 which carry the fabric through the steamer. The steamer is maintained at a temperature ranging between 210° to 230°F, and the time interval that a given segment of fabric remains in the steamer is approximately 8 to 10 minutes. The temperature range and time interval being representative for processing a number of different type fabric but may be varied to suit a specific situation. The steamer 30 achieves fixation of the dye that has been applied to the fabric.

Steam is introduced into the steamer 30 by steam feed pipe 34. The steamer is vented to the atmosphere at its top by stack 36. As the steamed fabric completes its transverse through the steamer 30 it moves over exit roller 37 whereupon the fabric moves downwardly between baffle 38 and wall section 39 towards the exit throat 40. Positioned between the baffle plate 38 and wall section 39 are a plurality of water spray pipes 41 that facilitates the cool-down of the steamed fabric.

Referring to FIG. 3, it will be seen that as the steamed fabric leaves the steamer 30 through exit throat 40 it enters wash-box 50 wherein the water level 52 is controlled by conventional means (not shown) and maintained at a height above the exit throat 40 so that in effect a steam-water seal is provided. The steam-water seal is further maintained by depending baffle 53. The steamed fabric is not subjected to the atmosphere prior to entry into the wash-box 50.

The wash-box includes a plurality of upper rollers 54 and lower rollers 55. Also, included are a plurality of water spray pipes 56. Any number of wash-boxes may be used in tandem.

As the fabric F leaves the wash-box 50 it moves through a water extractor 60 thence upwardly and over roller 65 and thence downwardly through folding mechanism 70 which reciprocates transversely above the buggy 75 which receives the folded and completed dyed product.

The following Examples and Formulae are illustrations of different dye chemical mixtures that may be utilized with different fibers for carrying out the present invention.

EXAMPLE NO. 1

Fiber Type:Polyamide (spun)
Dye Pickup Ratio:300%
Liquid Pump Speed 800RPM
Homogenizer Speed:300RPM
Air Pressure:38psi
Steamer Temperature:215°F.
Machine Speed:15fpm
PH:7.2

FORMULA

| | | |
|---|---|---|
| Dyes (grams per 1000 lbs. dye paste) | | |
| *Dye A | 1150 | |
| Dye B | 53 | |
| Dye D | 138 | |
| Dye E | 96 | |
| CHEMICALS: (lbs. per 1000 lbs. dye paste) | | |
| TSP (Sodium Phosphate, Tribasic) | | 2.6 |
| MSP (Sodium Phosphate, Monobasic) | | 2.6 |
| **Chemical EE | | 3.0 |
| Chemical BB | | 5.0 |
| Chemical CC | | 1.0 |

NOTE:
*The dyes indicated by "Letter Designation" in the following formulae are identified by Color Index, Trade Name, and Type Compound Supplier in Table A.

**The chemicals indicated by "Letter Designation" in the following formulae are identified by Trade Name and Chemical Nature in Table B.

EXAMPLE No. 2

Fiber Type: Acrylic (Cationic/Acid Dyeable)
Dye Pickup Ratio:300%
Liquid Pump Speed:800 RPM
Homogenizer Speed:300 RPM
Air Pressure:38psi
Steamer Temperature:215°F.
Machine Speed:15fpm
pH:3.5

FORMULA

| | | |
|---|---|---|
| Dyes: (grams per liter) | | |
| Dye E | 2.350 | |
| Dye F | .033 | |
| Dye G | 1.780 | |
| Dye H | .132 | |
| Dye I | .165 | |
| CHEMICALS: (grams per liter) | | |
| Chemical BB | | 10.00 |
| Atric Acid | | 4.00 |
| Sodium Thiosulfate | | .33 |
| Chemical DD | | 3.00 |
| Chemical CC | | 5.00 |

EXAMPLE No. 3

Fiber Type: Polyester
Dye Pickup Ratio:400%
Liquid Pump Speed: 800RPM
Homogenizer Speed:300RPM
Air Pressure:38psi
Steamer Temperature:220°F.
Machine Speed:15fpm
pH:5.5

FORMULA

| | | |
|---|---|---|
| Dyes: (grams per liter) | | |
| Dye J | .08 | |
| Dye K | .16 | |
| Dye L | 1.10 | |
| CHEMICALS: (grams per liter) | | |
| Chemical GG | | 12.0 |
| Chemical FF | | 1.5 |
| Citric Acid | | .5 |
| Chemical DD | | 1.5 |
| MSP (Sodium Phosphate, Monobasic | | 1.0) |

EXAMPLE No. 4

Fiber Type: polyamide (Filament)
Dye Pickup Ratio:300%
Liquid Pump Speed:800RPM
Homogenizer Speed:300RPM
Air Pressure:38psi
Steamer Temperature:215°F.
Machine Speed:18fpm
pH:6.7

FORMULA

| | | |
|---|---|---|
| Dyes: (grams per liter) | | |
| Dye M | 4.12 | |
| Dye H | .53 | |
| Dye N | 2.67 | |
| CHEMICALS: (grams per liter) | | |
| Chemical BB | | 10.0 |
| Chemical CC | | 3.0 |
| MSP(Sodium Phosphate, Monobasic) | | 4.0 |
| TSP(Sodium Phosphate, Tribasic) | | 2.5 |
| Chemical DD | | 3.0 |

EXAMPLE No. 5

Fiber Type: Polyamide (Regular/Acid Dyeable)
Dye Pickup Ratio:300%
Liquid Pump Speed:800RPM Homogenizer Speed:300RPM
Air Pressure:38psi
Steamer Temperature:215°F.
Machine Speed:15fpm
pH:7.1

FORMULA

| | | |
|---|---|---|
| Dyes: (grams per 1000 lbs. dye paste) | | |
| Dye 0 | 192 | |
| Dye L | 288 | |
| Dye P | 28 | |
| Dye D | 16 | |
| Dye Q | 288 | |
| Dye H | 20 | |
| Dye R | 10 | |
| CHEMICALS: (lbs. per 1000 lbs. dye paste) | | |
| TSP(Sodium Phosphate, Tribasic) | | 2.6 |
| MSP(Sodium Phosphate, Monobasic) | | 2.6 |
| Chemical EE | | 3.0 |
| Chemical BB | | 5.0 |
| Chemical CC | | 1.0 |

EXAMPLE No. 6

Fiber Type: Polyamide (Regular/Acid Dyeable)
Dye Pickup Ratio:300%
Liquid Pump Speed:800RPM
Homogenizer Speed:300RPM
Air Pressure:38psi
Steamer Temperature:215°F.
Machine Speed:15fpm
pH:7.0

FORMULA

| | | |
|---|---|---|
| Dyes: (grams per 1000 lbs. dye paste) | | |
| Dye B | 690 | |
| Dye S | 996 | |
| Chemicals: (lbs. per 1000 lbs. paste) | | |
| TSP(Sodium Phosphate, Tribasic) | | 2.6 |
| MSP(Sodium Phosphate, Monobasic) | | 2.6 |
| Chemical EE | | 3.0 |
| Chemical BB | | 5.0 |

EXAMPLE No. 7

Fiber Type: Polyamide (Cut Plush)
Dye Pickup Ratio:300%
Liquid Pump Speed:800RPM
Homogenizer Speed:300RPM
Air Pressure:38psi
Steamer Temperature:215°F.
Machine Speed:15fpm
pH:9.0

FORMULA

| | | |
|---|---|---|
| Dyes: (grams per 1000 lbs. dye paste) | | |
| Dye L | 3630 | |
| Dye P | 54 | |
| Dye D | 30 | |
| CHEMICALS: (lbs. per 1000 lbs. dye paste) | | |
| Chemical BB | | 10 |
| Chemical EE | | 3 |
| TSP(Sodium Phosphate, Tribasic) | | 1 |

EXAMPLE No. 8

Fiber Type: Polyamide (Regular/Acid/Cationic)
Dye Pickup Ratio:350%
Liquid Pump Speed:850RPM
Homogenizer Speed:300RPM
Air Pressure:35psi
Steamer Temperature:215°F.
Machine Speed:15fpm
pH:7.1

FORMULA

| | | |
|---|---|---|
| Dyes: (grams per 1000 lbs. dye paste) | | |
| Dye H | 96 | |
| Dye T | 384 | |
| Dye U | 480 | |
| Dye V | 17 | |
| Dye W | 384 | |
| CHEMICALS: (lbs. per 1000 lbs. dye paste) | | |
| TSP(Sodium Phosphate, Tribasic) | | 2.6 |
| MSP(Sodium Phosphate, Monobasic) | | 2.6 |
| Chemical EE | | 3.0 |
| Chemical BB | | 10.0 |
| Chemical CC | | 1.0 |

EXAMPLE No. 9

Fiber Type: Polyamide (Continuous Filament Cut Pile)
Dye Pickup Ratio:300%
Liquid Pump Speed:800RPM
Homogenizer Speed:300RPM
Air Pressure:38psi
Steamer Temperature:215°F.
Machine Speed:15fpm
pH:7.1

FORMULA

| | | |
|---|---|---|
| Dyes: (grams per 1000 lbs. dye paste) | | |
| Dye L | 624.0 | |
| Dye P | 9.6 | |
| Dye D | 32.6 | |
| CHEMICALS: (lbs. per 1000 lbs. dye paste) | | |
| Chemical BB | | 10.00 |
| Chemical EE | | 3.00 |
| TSP(Sodium Phosphate, Tribasic) | | .75 |

EXAMPLE No. 10

Fiber Type: Polyamide (Regular/Acid/Cationic Dyeable)
Dye Pickup Ratio:300%
Liquid Speed:900RPM
Homogenizer Speed:300RPM
Air Pressure:38psi
Steamer Temperature:215°F.
Machine Speed:18fpm
pH:6.8

FORMULA

| | | |
|---|---|---|
| Dyes: (grams per 1000 lbs. dye paste) | | |
| Dye W | 308 | |
| Dye X | 78 | |
| Dye N | 613 | |
| CHEMICALS: (lbs. per 1000 lbs. dye paste) | | |
| Chemical EE | | 2 |
| Chemical HH | | 1 |
| Chemical BB | | 5 |
| Ammonium Acetate | | 2 |

EXAMPLE No. 11

Fiber Type: Polyamide
Dye Pickup Ratio:325%
Liquid Pump Speed:900RPM
Homogenizer Speed:300RPM
Air Pressure:38psi
Steamer Temperature:215°F.
Machine Speed:18fpm pH:9.0

FORMULA

| | | |
|---|---|---|
| Dyes: (grams per 1000 lbs. dye paste) | | |
| Dye L | 4400 | |
| Dye P | 440 | |
| CHEMICALS: (lbs. per 1000 lbs. dye paste) | | |
| Chemical BB | | 5.00 |
| Chemical EE | | 3.00 |
| TSP(Sodium Phosphate, Tribasic) | | .75 |

EXAMPLE No. 12

Fiber Type: Polyamide (Antron II Regular/Acid/Cationic Dyeable)
Dye Pickup Ratio:250%
Liquid Pump Speed:800RPM
Homogenizer Speed:300RPM
Air Pressure:38psi
Steamer Temperature:215°F.
Machine Speed:15fpm
pH:7.1

FORMULA

| | | |
|---|---|---|
| Dyes; (grams per 1000 lbs. dye paste) | | |
| Dye L | 390 | |
| Dye Y | 21 | |
| Dye W | 91 | |
| Dye Z | 442 | |
| Dye AA | 1760 | |
| Dye H | 117 | |
| Dye R | 176 | |
| CHEMICALS: (lbs. per 1000 lbs. dye paste) | | |
| TSP(Sodium Phosphate, Tribasic) | | 2.6 |
| MSP(Sodium Phosphate, Monobasic) | | 2.6 |
| Chemical BB | | 5.0 |
| Chemical EE | | 3.0 |
| Chemical CC | | 1.0 |

TABLE A

| Dye No. | AATCC Color Index No. | COLOR INDEX | TYPE COMPOUND | Trade Name |
|---|---|---|---|---|
| A | Direct Yellow 44 | 29000 | | Direct F Yellow 4 GLN Conc. |
| B | Direct Red 1 | 22310 | | Direct Red F 100% |
| C | Direct Blue 218 | 24401 | | Pontamine Blue 7 GLN |
| D | Disperse Blue 56 | | anthraquinone | Palanil Blue R |
| E | Basic Blue 35 | | anthraquinone | Sevron Blue BGL |
| F | Basic Yellow 32 | | | Deorlene Yellow 4RL |
| G | Acid Yellow 17 | 18965 | | Amacid Lt Yellow 2G Conc. |
| H | Acid Red 37 | 17045 | | Amacid F Red BL |
| I | Acid Blue 37 | 62085 | | Alizarine Lt. Blue R |
| J | Disperse Blue 120 | | | Polyester Blue BLF |
| K | Disperse Red 60 | | anthraquinone | Polyester Red FFBL |
| L | Disperse Yellow 64 | | | Palanil Yellow 3G |
| M | Acid Yellow 19 | | azo | Xylene Yellow R |
| N | Acid Blue 80 | 61585 | | Milling Blue BL |
| O | Direct Orange 116 | | | Solophenyl Orange ARL |
| P | Disperse Red 55 | | anthraquinone | Amacel Brill. Pink BFS |
| Q | Acid Yellow 38 | 25135 | | Milling Yellow O |
| R | Acid Blue 92 | 13390 | | Sulfonine Blue R |
| S | Direct Red 37 | 22240 | | Peeramine Scarlet B |
| T | Mordant Orange 6 | 26520 | | Neutral Orange G |
| U | Basic Yellow 15 | | monoazo | Sevron Yellow 3RL |
| V | Basic Red 17 | | monoazo | Sevron Red L |
| W | No. C.I. No. | | | Genacryl Blue RGL |
| X | Basic Yellow 21 | | polymethine | Astrazon Yellow 7GLL |
| Y | Disperse Blue 7 | 62500 | | Amacel Green Blue B |
| Z | Basic Orange 25 | | monoazo | Sevron Orange CL |
| AA | Direct Yellow 106 | | stilbene | Amanil Yellow 2RLL |

1. E. I. DuPont de NeMours and Co.
2. BASF Colors and Chemicals, Inc.
3. American Aniline Products, Inc.

TABLE B

| Chemical No. | Trade Name | Chemical Nature |
|---|---|---|
| BB | Barisol BRM 400 | Phosphated Alcohol |

TABLE B-continued

| Chemical No. | Trade Name | Chemical Nature |
|---|---|---|
| CC | Cibaphasol AS | Sulfuric Acid Ester |
| DD | Progacyl O | Locustbean gum derivative |
| EE | Seatex X-HV | Sodium Alginate Thickener |
| FF | Sandogen CWF | Organic Foaming agent |
| GG | Carrier S-364 | Biphenyl solvent mixture |
| HH | Progalan X-12 | Not available |

[1]Ciba Chemical and Dye Co.

I claim:

1. A method of continuously uniformly dyeing textile fibrous material comprising the steps of:

a. producing a large body of homogeneous foam at a pressure above atmospheric pressure, said foam containing a dye and a wetting agent and a biphenyl solvent;

b. dispensing said foam at atmospheric pressure by foam dispensing means;

c. receiving said foam from said dispensing means in a foam dye box vented to the atmosphere;

d. positioning said foam dispensing means above said box such that said foam is discharged into said box;

e. immersing said material in said foam and running said material repeatedly upwardly and downwardly through said foam at atmospheric pressure to effect penetration of said foam into said material, said material being continuously conveyed by roller means including at least one roller positioned in said box;

f. transversely reciprocating said dispensing means across the breadth of said box whereby said foam is discharged into said box at a level such that said roller is covered by said foam;

g. removing a predetermined amount of said foam from said material upon exit of said material from said foam by adjustable means; and h. effecting fixation of said dye on said foam penetrated material by steaming said material.

2. A method of continuously uniformly dyeing textile fibrous material according to claim 1 further including the step of maintaining said foam within a density range of 0.2 to 0.4.

3. A method of continuously uniformly dyeing textile fibrous material according to claim 1 further including the step of maintaining said foam within a pH range of 3 to 9.

4. A method of continuously uniformly dyeing textile fibrous material according to claim 1 further including the step of maintaining said foam within a specific gravity range of 0.2 to 0.3.

5. A method of continuously uniformly dyeing textile fibrous material according to claim 1 and further characterized by the step of washing said dyed material.

* * * * *

UNITED STATES PATENT OFFICE
CERTIFICATE OF CORRECTION

PATENT NO. : 3,954,404

DATED : May 4, 1976

INVENTOR(S) : Billy M. Childers and Charles D. Fesperman, Jr.

It is certified that error appears in the above-identified patent and that said Letters Patent are hereby corrected as shown below:

Column 2, line 12, "due" should be --dye--;
Column 3, line 11, delete "of";
Column 6, line 34, after 0.4 "of" should be --or--;
Column 7, line 9, "transverse" should be --traverse--;
Column 7, line 62, in Note*, delete "Supplier".

Signed and Sealed this

Sixteenth Day of November 1976

[SEAL]

*Attest:*

RUTH C. MASON
*Attesting Officer*

C. MARSHALL DANN
*Commissioner of Patents and Trademarks*